US010471752B2

(12) United States Patent
Stowe et al.

(10) Patent No.: US 10,471,752 B2
(45) Date of Patent: Nov. 12, 2019

(54) ANILOX PATTERNS AND DOCTOR BLADES FOR METERING HIGH VISCOSITY PIGMENTED INKS

(71) Applicant: PALO ALTO RESEARCH CENTER INCORPORATED, Palo Alto, CA (US)

(72) Inventors: Timothy D. Stowe, Alameda, CA (US); Gregory B. Anderson, Emerald Hills, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 15/230,954

(22) Filed: Aug. 8, 2016

(65) Prior Publication Data

US 2018/0037044 A1 Feb. 8, 2018

(51) Int. Cl.

| | |
|---|---|
| ***B41F 1/18*** | (2006.01) |
| ***B41M 1/06*** | (2006.01) |
| ***B41F 31/00*** | (2006.01) |
| ***B41F 31/02*** | (2006.01) |
| ***B41F 31/04*** | (2006.01) |

(52) U.S. Cl.

CPC ..... *B41M 1/06* (2013.01); *B41F 31/002* (2013.01); *B41F 31/005* (2013.01); *B41F 31/027* (2013.01); *B41F 31/04* (2013.01); *B41P 2227/70* (2013.01)

(58) Field of Classification Search

CPC ..... B41F 31/04; B41F 31/007; B41F 31/20; B41F 31/027; B41F 31/002; B41F 31/005; B41P 2231/20; B41P 2231/22; B41P 2227/70; B41M 1/06

See application file for complete search history.

(56) References Cited

U.S. PATENT DOCUMENTS

| | | | | |
|---|---|---|---|---|
| 2,711,132 A | | 6/1955 | Viscardi | |
| 3,360,466 A | * | 12/1967 | Short | H01F 1/445 106/31.64 |
| 3,468,248 A | * | 9/1969 | Giori | B41F 9/1018 101/167 |

(Continued)

FOREIGN PATENT DOCUMENTS

| | | |
|---|---|---|
| DE | 101 12 417 | 7/2002 |
| EP | 2 574 464 | 4/2013 |
| WO | WO 2008/152022 | 12/2008 |

OTHER PUBLICATIONS

Proline ART and REV Engravings, Praxair Surface Technologies.*
What's your reputation worth?, Praxair Surface Technologies.*

*Primary Examiner* — Jill E Culler
*Assistant Examiner* — Marissa Ferguson-Samreth
(74) *Attorney, Agent, or Firm* — Caesar Rivise, PC

(57) ABSTRACT

A chamber blade system maximizes ink flow at an anilox doctor blade by including a heating element adjacent the doctor blade to heat ink adjacent the blade. The heating element may be a heat strip next to an anilox doctor blade that heats the ink adjacent the doctor blade and temporarily reduces the ink viscosity to improve the flow of ink in the vicinity of the blade. Doctoring blades with a ceramic tip coating may be configured to allow a small amount of controlled ink flow through that can wet the lands thereby reducing the hydrodynamic back pressures and friction when trying to force the ink into anilox cells.

6 Claims, 5 Drawing Sheets

(56) References Cited

U.S. PATENT DOCUMENTS

| | | | | |
|---|---|---|---|---|
| 4,119,836 | A | 10/1978 | Motokawa | |
| 6,431,066 | B1 * | 8/2002 | Perez | B41F 31/027 101/157 |
| 9,216,568 | B2 | 12/2015 | Stowe | |
| 2011/0222924 | A1 * | 9/2011 | Aoyama | G03G 15/2096 399/327 |
| 2012/0103212 | A1 | 5/2012 | Stowe et al. | |
| 2013/0025487 | A1 * | 1/2013 | Liu | B41F 31/00 101/425 |
| 2015/0064419 | A1 * | 3/2015 | Stolarz, Jr. | C09D 11/50 428/199 |

* cited by examiner

ANILOX PATTERNS AND DOCTOR BLADES FOR METERING HIGH VISCOSITY PIGMENTED INKS

FIELD OF DISCLOSURE

The disclosure relates to variable data lithographic printing. In particular, the disclosure relates to keyless inking methods and inking systems for use in variable data lithographic printing systems.

BACKGROUND

Traditional offset printing does not allow for variable data printing. The inking subsystem used applies ink over a static plate image. Typically, ink is depleted from an inker form roll as the ink is transferred onto the imaging plate, the ink form roller being the last roller that is in direct contact with the imaging plate. Different regions of the imaging plate may need more or less ink depending upon which regions are oleophilic foreground areas and which regions are oleophobic background image areas.

Traditional offset ink delivery systems adjust ink flow to different regions of the plate using manually adjusted keys which change the ink feed rate in order to guarantee enough ink will flow in solid imaging regions but prevent too much ink from flowing to areas covered by fine lines or half tones.

Recently, keyless inker systems have been introduced which meter ink appropriately without the need for inker keys. Exemplary keyless inker systems include those sold by Koenig & Bauer AB group (KBA) located in Germany. Such keyless systems use a metered anilox roller to pull fresh ink uniformly out of an ink tray and deliver the ink directly to a rubber form roll which then transfers the ink to the an imaging plate. Such systems provide for more consistent ink flow regardless of whether a solid or fine artwork is being printed. However, the layer of ink remaining on the form roller after being partially transferred to the static image on an offset plate has a thickness that is not uniform. This is because ink splits onto the imaging plate in imaging areas but is fully rejected in non-imaging areas by the dampening fluid. Thus, the remaining non-uniform ink thickness on the form roller has a thickness pattern which reflects the image pattern printed onto the static plate. Thus, not all areas on the form roll are covered with the same thickness or amount of ink after transfer of ink onto the imaging plate and when new ink is transferred onto the form roller some of the old ink pattern partially remains.

To minimize these effects, keyless inking systems include a form roll that has a soft or conformable surface, an anilox metering roll, and an imaging plate that are all substantially equal in diameter. Further, since these rollers are all of equal diameter, related art keyless inking systems typically have large diameter anilox meter rollers and form rollers since the image plate is large in area, for example a B2-size sheet format. These rollers traditionally are of equal diameters so that ink imaging history effects are added "in-phase" with the image on the plate. The form roller then builds up a reproducible ink layer thickness "in phase" with the static offset plate image, which unfortunately leaves ghosting between print jobs.

For a variable data lithographic printing inker system, the ink film thickness must always be the same regardless of the imaging history because a new image may be introduced on each pass of the printing process. New images are introduced based on a new pattern of dampening solution formed by laser evaporation on each pass of the imaging cylinder containing a reimageable print surface. In addition, variable data lithography is different from static offset lithography because the ink is transferred directly to an elastomeric conformable blanket that holds the latent image in the dampening fluid after it has been laser patterned in contrast to traditional offset which holds a static fluid pattern over a hard metal offset plate surface. Thus, a new inker system is needed that is compatible with the unique requirements of a variable data lithography print system.

Efforts have been made to create lithographic and offset printing systems for variable data. One example is disclosed in U.S. Pat. No. 9,216,568 published Dec. 22, 2015, which is commonly assigned, and the disclosure of which is hereby incorporated by reference herein in its entirety, in which a chamber blade system is configured to supply ink to an anilox member of an inking system. The inking system includes a soft ink transfer roll and a hard form roll. Ink is transferred from the anilox roll to the form roll by way of the transfer roll, and from the form roll to a reimageable surface layer of an imaging member of a variable data lithographic system. An ink layer free of ink history is uniformly applied onto a surface of the form roll, and subsequently transferred to the reimageable surface layer while avoiding or substantially eliminating image ghosting. However, the inventors have discovered that it would be beneficial to provide further improved printing systems and methods for printing higher viscosity digital variable lithography highly pigmented inks.

Flexography (flexo) printing known to the inventors use anilox rollers in meter flexo inks in the 10 centipoise (cps) to 1,000 cps range. Anilox roll patterns include hexagonally packed ink well cells or trihelical grooves at a 30, or 60 degree angles. Such patterns come in various shapes and sizes and line screens (e.g., the minimum repeat distance). However, the high rheology inks utilized in digital variable lithography are not characteristic of traditional flexo inks. Hot temperature (e.g., at least about 60 degrees C.) rheology is in the range of 100,000-1,000,000 cps, and viscosity is above 1 million cps at lower temperatures (<40 degrees C.). The inventors found that none of these standard anilox engraving patterns adequately meter these inks due to high hydrodynamic pressures arising from their very high viscosity (e.g., at least 100,000-1 million cps).

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing an apparatus and method of variable data lithographic printing that maximizes ink flow at an anilox doctor blade by including a heating element adjacent the doctor blade to heat ink adjacent the blade. The heating element may be a heat strip next to an anilox doctor blade that heats the ink adjacent the doctor blade and temporarily reduces the ink viscosity to improve the flow of ink in the vicinity of the blade. Doctoring blades with a ceramic tip coating may be configured to allow a small amount of controlled ink flow through that can wet the lands thereby reducing the hydrodynamic back pressures and friction when trying to force the ink into anilox cells.

According to aspects illustrated herein, a variable data lithography apparatus useful in printing has an anilox member, a chamber blade system and a heater. The anilox member is configured to carry ink for transfer to an imaging member having a conformable reimageable surface layer for variable data lithographic printing. The chamber blade system includes an ink housing and an anilox doctor blade. The ink housing is configured to store the ink. The anilox doctor blade is configured to meter the stored ink onto the anilox member and to doctor excess ink from surface lands of the anilox member. The heater is spatially separate from the anilox member and configured to heat the ink near the anilox doctor blade and to reduce the viscosity of the ink to increase ink flow where the anilox roll doctor blade meters the heated ink onto the anilox member.

An exemplary method of variable data lithographic printing that maximizes ink flow at an anilox doctor blade includes heating ink within an ink housing of a chamber blade system ink near an anilox doctor blade with a heater spatially separate from an anilox member and configured to heat the ink near the anilox doctor blade and the anilox member to reduce the viscosity of the ink to increase ink flow, metering the heated ink from the ink housing onto the anilox roll with the anilox doctor blade that contacts the outer surface of the anilox roll, and transferring the metered ink from the anilox roll to an imaging member having a conformable reimageable surface layer for variable data lithographic printing.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
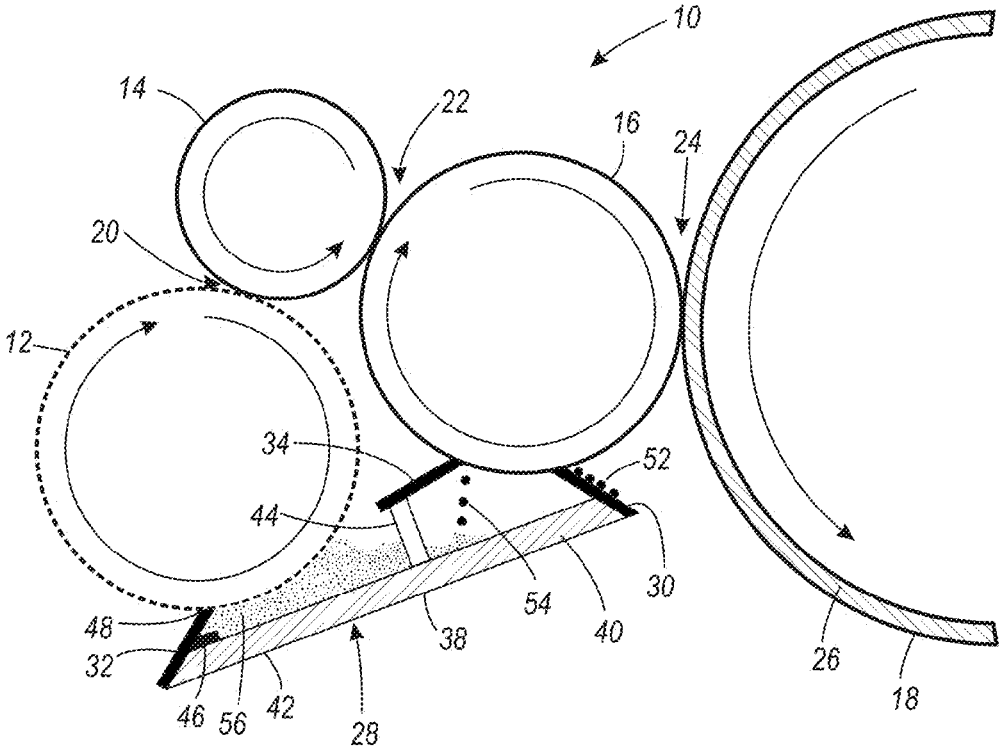
FIG. 1 is a side view of a variable lithographic inking system in accordance with an example of the embodiments.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of resistors" may include two or more resistors.

When referring to any numerical range of values herein, such ranges, are understood to include each and every number and/or fraction between the stated range minimum and maximum. For example, a range of 0.5-6% would expressly include all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The terms "print media", "print substrate" and "print sheet" generally refers to a usually flexible physical sheet of paper, polymer, Mylar material, plastic, or other suitable physical print media substrate, sheets, webs, etc., for images, whether precut or web fed.

The term "printing device" or "printing system" as used herein refers to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

All physical properties that are defined hereinafter are measured at 20° to 25° C. unless otherwise specified. Hot temperature rheology refers to rheology at about 60° C. and above. Lower temperature rheology refers to rheology at about 40° C. and below. The term "room temperature" refers to 25° C. unless otherwise specified.

Compact variable lithographic keyless inking systems that reduce ghosting issues and improve very high viscosity pigmented ink metering are provided. Methods, apparatus, and systems accommodate reduced or substantially eliminated ghosting by cleaning a hard ink transfer form member with a doctor blade to remove ink leftover after ink transfer to a reimageable surface. The removed ink may be recycled for resupply to an anilox roll of the inking system, and subsequent transfer to the form roll. The ink transfer members of the inking system need not be large or of equal size.

Inking systems or inking apparatuses in accordance with embodiments may be incorporated into a variable lithographic architecture so that the inking system is arranged about a central drum holding an imaging member whose outer surface is a conformable reimageable surface layer (e.g., silicone composite, fluorosilicone composite). A paper path architecture may be situated about the imaging member to form a media transfer nip.

A uniform application of dampening fluid may be applied to the reimageable surface layer of the central imaging cylinder holding an imaging member using a dampening fluid subsystem. In the digital evaporation step, particular portions of the dampening fluid layer applied to the surface of the central imaging member may be evaporated by a digital evaporation system. For example, portions of the dampening fluid layer may be evaporated by laser patterning.

In an inking step, ink may be transferred from an inking system to the reimageable surface layer of the imaging member. In examples, the transferred ink adheres to portions of this surface where dampening fluid has been evaporated. In a partial cure step, the transferred ink may be partially cured by irradiation. For example, UV cure source(s) may be arranged about the imaging member. In an image transfer step, the transferred ink may be transferred to print media at a media transfer nip.

A surface of the central imaging cylinder may be cleaned by a cleaning system. For example, tacky cleaning rollers may be used to clean the surface of the central imaging member. In a variable lithographic printing process, previously imaged ink must be removed from the imaging member to prevent ghosting. New ink applied to the imaging plate from an inking system should have no history of ink thickness depletion in the form roller due to prior ink transfer.

The inking system may include an inking member such as an anilox roll. The anilox roll may have wells or cells in a surface thereof for carrying ink to the imaging member. The wells may be mechanically or laser engraved, and may be configured to contain a volume of ink. The anilox roll may be configured in an inking system so that a surface of the roll is submerged in an ink chamber or ink sump. An anilox doctor blade may be arranged to contact a surface of the anilox roll for leveling ink supplied to the roll by the ink sump as the anilox roll rotates in a process direction. In examples the anilox roll may be configured to transfer ink directly or indirectly to the reimageable surface layer of the imaging member.

The inking system may include an intermediate soft transfer roll. The transfer roll may have a soft, conformable surface made of, for example, a rubber such as EPDM or nitrile rubber that is compatible with the ink chemistry. The transfer roll may be configured to define a first ink transfer nip with the anilox roll. Ink may be metered onto the transfer roll at the first ink transfer nip. The transfer roll may be urged against the anilox roll to squeeze the ink at the first ink transfer nip to spread and smooth the ink as the ink is metered onto the transfer roll.

An ink form member such as a roll having a hard surface may be arranged to define a second transfer nip with the soft intermediate transfer roll. The ink form roll may be a cylindrical drum or other suitable member. The ink form roll may include a hard surface. For example, the ink form member may be a roll having a surface comprising metal. The ink member may be an aluminum drum. The drum may have a diameter in the range of about 2 to about 3 inches diameter. Alternatively, the ink form roll may have a highly durable, hard outer surface comprising plated chrome or an alumina ceramic coating.

The hard surface of the form member enables use of a doctor blade for cleaning ink from the form member. For example, a doctor blade may be applied to the surface of the form roll to wipe or scrape ink from the form member that is leftover after transferring ink to an imaging member. Ghostless variable data printing with offset ink requires that an inker subsystem form roll have substantially no prior ink history from a prior process of transferred ink onto an imaging plate. Because the surface of the form member is hard, the doctor blade can be applied without degrading the form member surface.

The intermediate transfer member may apply a pressure at the second transfer nip to squeeze the ink as the ink is metered onto the form member. The soft surface of the transfer member mitigates the metering pattern of the ink and facilitates spreading and smoothing of the ink at both the first and second transfer nips. The soft intermediate transfer member may be configured for oscillation back and forth against the first and second nips in alternating succession. Additional members such as rolls may be used to enhance ink smoothing.

A diameter of an intermediate transfer member such as a transfer roll and a form member such as a form roll may be different. Further, the anilox member, transfer member, and form member may have a diameter that is significantly smaller than related art anilox rolls, which are typically over 5 inches or more in diameter. Accordingly, an overall size of an inking systems having inking members in accordance with embodiments may have a reduced size, weight, and overall system cost in comparison with related art systems.

The intermediate member may be a transfer roll that is configured to rotate at a first angular velocity. The form member may be a form roll that is configured to rotate at a second angular velocity. At least one of the first angular velocity and the second angular velocity may be slightly adjusted to enhance smoothing and spreading of ink at the second ink transfer nip for metering a uniform layer of ink onto the hard surface of the form roll. Further, the anilox member may be a temperature controlled anilox roll. The temperature of the anilox roll may be adjusted to bring the ink to a temperature that enhances spreading and smoothing of the ink at, for example, the first transfer nip. Further, a pressure applied at the ink transfer nips may be adjusted by adjusting, for example, the pressure applied by the intermediate transfer member, to accommodate inks of particular thicknesses. These parameters may be adjusted for varying a thickness and optical density of an ink layer on a reimageable surface layer of an imaging member used in variable data lithography.

The form member may be configured to contact the outer reimageable surface layer and transfer ink without ink thickness variation or history of prior inking patterns onto the reimageable surface layer thereof. The imaging member and reimageable surface layer member may be configured as described by Stowe et al. in "Variable Data Lithography System" (U.S. Patent Application Publication No. 2012/0103212 A1 published May 3, 2012, and based on U.S. patent application Ser. No. 13/095,714, which is commonly assigned, and the disclosure of which is hereby incorporated by reference herein in its entirety), as appropriate. For example the reimageable surface may be made from a soft silicone blanket material.

A chamber blade system in accordance with embodiments may include a removed ink reservoir. Chamber blade system may be located adjacent to a form member so that ink cleaned from the form member may be captured at the removed ink reservoir. The chamber blade system may include an ink sump. The ink sump may be configured to communicate with the removed ink reservoir, so that the ink sump may receive ink from the ink reservoir. For example, the chamber blade system may be constructed to define a cavity having an upper portion and a lower portion. The upper portion of the cavity may be positioned beneath a form roll, and may include an ink reservoir. Ink removed from the form roll may fall into the reservoir of the upper portion of the cavity. The lower portion of the ink cavity may include an ink sump. The ink reservoir and the ink sump of the cavity may share a common bottom member that contains the ink in the chamber blade system. Ink received at the reservoir may fall down the common bottom portion from the reservoir and into the ink sump.

A portion of the anilox member may be submerged in ink at the ink sump. For example, the anilox member may be an anilox roll that rotates through the ink contained in the ink sump whereby the ink sump supplies ink to a surface of the anilox roll. The ink may be contained in the cells of the anilox roll, and excess ink on a surface of the roll may be cleaned using an anilox doctor blade. The anilox doctor blade may be configured to doctor excess ink deposited in a cell of the inking member from the surface of the inking member. A chamber blade may be associated with the ink chamber. The chamber blade and the doctor blade may be configured to contain ink within the chamber. For example, the chamber blade and doctor blade, and bottom portion of the chamber blade system, in combination, may be configured to contain ink inside the ink chamber.

The chamber blade system may also include a form member doctor blade that is configured to contact a surface of the form member. The form member doctor blade may be formed of a material comprising metal. The form member doctor blade may be formed of a hard material that is suitable for scraping ink from a surface of the hard form member. The form member doctor blade may be oleophobic, and may include, for example, fluorocarbon materials such as TEFLON®. In an inking system having a chamber blade system in accordance with an embodiment, the form member doctor blade may be arranged to contact a portion of the form member that is located directly above and facing the removed ink reservoir of the chamber blade system. As the form roll, for example, rotates in a process direction, the form member doctor blade may contact the surface of the form member to remove ink from the surface of the form member, causing the ink to fall into the ink reservoir.

During transfer of the deposited ink from the form member to the imaging member, dampening fluid from the surface of the inking member may be transferred to the inking member. In an embodiment, a form member chamber blade may be made from a hydrophilic flexible material such as microporous nitrile butadiene rubber (NBR) which promotes the removal of water based dampening fluid from the surface of the ink coating the form member due to chemical diffusion away from the ink and into the chamber blade. Alternatively, if a hydrofluoroether based dampening fluid is used in digital variable lithographic, the form member chamber blade may be of a flexible fluorocarbon material such as viton which selectively promotes the removal of the hydrofluoroether dampening fluid from the ink by drawing it away from the surface. Thus, the form member chamber blade material may be made of a flexible oleophobic material which promotes selective absorption and removal of the dampening fluid based upon the dampening fluid chemistry.

The form member chamber blade may be configured to contact a portion of the form member that includes ink and dampening fluid leftover form ink transfer at a third ink transfer nip defined by an imaging member and the form member. For example, with respect to a process direction, the form member chamber blade may be configured to contact a surface of the form member and remove dampening fluid therefrom before the form member doctor blade contacts a surface of the form member to remove leftover ink therefrom. Accordingly, ink removed from the surface of the form member may be substantially free of dampening fluid. The ink that is substantially free of dampening fluid may include a negligible amount of dampening fluid that is present in an amount that is low enough to be acceptable for resupply of the ink to the anilox member without degrading ink transfer or ink printing. As such, in an embodiment wherein the removed ink may be added to the ink sump for resupply to an anilox member, the ink supply may remain substantially free of dampening fluid. Accordingly, ink removed from the form member by cleaning the form member with the doctor blade may be recycled for resupply to the inking system.

The inventors found empirical problems that arise during doctoring of these inks with the doctor blade at the anilox roll is that the hydrodynamic pressures of scoping ink into the cells are too high and lead to blade vibration and hydroplaning. This can cause so called UV ink spitting or ink pass through on the backside of a blade to randomly increase, leading to sporadic print defects. In an example, the angle of the doctoring blade to the tangent of the anilox roll is set below 30 degrees. This provides the benefit of reducing hydrodynamic back pressures on the ink and reduces the magnitude of UV ink spitting. Lowering the angle of the doctoring blade also may increase hydroplaning, where the ink is not fully doctored cleanly resulting in a thin layer of ink that rides on top of the anilox cell structure. The use of long anilox cell grooves such as a trihelical structure reduces ink hydroplaning but the very high viscosity inks having a viscosity over 100,000 centipoise (cps) may not adequate bridge the walls of these structures, which may lead to line gap defects in the print image. Exemplary embodiments solve these deficiencies with an anilox pattern geometry with minimal top flat lands area and minimal hydrodynamic back pressures as well as a blade geometry capable of metering high viscosity inks without increased wear and with good uniformity and good image fidelity.

In examples, a chamber blade system maximizes ink flow at an anilox doctor blade by making sure it is warm enough to achieve lower levels of viscosity. In examples, a chamber blade system includes a heating element adjacent an anilox doctor blade to heat ink adjacent the blade. The heating element may be directly next to an anilox doctor blade holder that the flow of ink in the vicinity of the blade can be dramatically improved by temporarily reducing the ink viscosity in the region inside the chamber on the backside of the blade where ink often piles up if the chamber is not completely filled. This high viscosity ink may get backed up behind the doctor blade where ink flow may be difficult. In this environment the ink's temperature may drop due to poor thermal conduction, thus, allowing its viscosity to increase further and making ink flow even more difficult. Though the doctor blade may tend to heat up due to friction, the blade may also cool down by entrained air flow around the anilox roller during rotation thereof. The inventors found that heat from a controlled heater near the doctor blade, for example, near the back of the blade clamp, may dramatically improve ink flow of high viscosity inks in the vicinity of the doctoring blade of a chamber blade system. Doctoring blades with a ceramic tip coating may be configured to allow a small amount of controlled ink flow through that can wet the lands thereby reducing the hydrodynamic back pressures and friction when trying to force the ink into anilox cells.

FIG. 1 depicts an exemplary apparatus and system for variable lithographic keyless inking in accordance with an embodiment. Specifically, FIG. 1 shows an inking apparatus 10 having an anilox roll 12, an intermediate transfer roll 14, and a form roll 16. FIG. 1 shows the inking apparatus arranged with a digital imaging member 18. While the figures show components that are formed as rolls, other suitable forms and shapes may be implemented.

The anilox roll 12 is a cylindrical rotatable roll having cells or wells defined in a surface thereof. The cells may be mechanically or laser engraved. The anilox roll 12 may be submerged in supply ink, and may be rotated through the ink for uptaking ink into the cells. The anilox roll may be heated, and may be temperature controlled. Depending on properties of the ink being used, such as a viscosity of the ink, a temperature of the anilox member may be adjusted improved smoothing and spreading of the ink at one or more ink transfer nips of the inking system.

Figure 2:
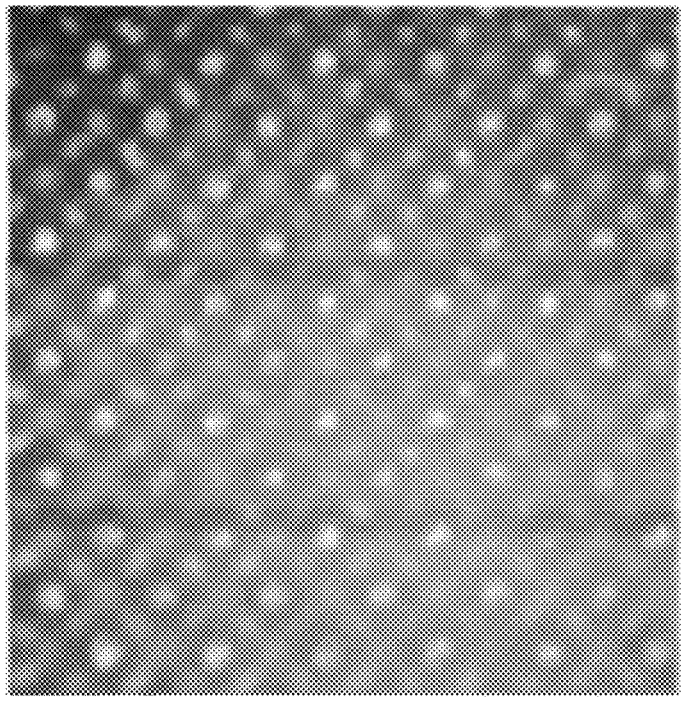
FIG. 2 shows an exemplary ART engraving pattern of a surface of an anilox member.

The examples include an anilox roll cell structure that has minimal hydrodynamic back pressure, yet still maintains image fidelity and a high line screen count. Exemplary embodiments, such as the anilox roll 12 include an Anilox Reverse Technology (ART) engraved pattern (e.g., commercially available from Praxair Surface Technologies) dramatically improves doctoring of very high viscosity inks and allows reasonable blade pressures in the range of 20-80 psi without the UV spitting problems discussed above and associated with hydrodynamic back pressures. For high image fidelity and high pigment loaded inks, the exemplary anilox rolls include a high line screen (e.g., at least about 800 cells per inch or Lines Per Inch (LPI)) and an anilox cell volume (e.g., about 2-3 Billions of Cubic Microns (BCM)) to adequately meter the appropriate amount of very high viscosity ink with high enough image fidelity. The exemplary ART pattern depicted in FIG. 2 is a tipped pattern configured to allow maximum very high viscosity ink coverage and minimal land area.

Referring back to FIG. 1, the intermediate transfer roll 14 may define a first ink transfer nip 20 with the anilox roll 12. Ink carried by the anilox roll 12 may be carried to the first ink transfer nip 20, and metered onto the intermediate transfer roll 14 in a uniform layer. The intermediate transfer roll 14 may have a diameter that is greater than or less than a diameter of the anilox roll 12. The intermediate transfer roll 14 may be driven passively through surface friction with the anilox roll in order to achieve a matching surface speed. The transfer roll surface thereby rotates in unison with surface of the anilox roll but the angular direction of rotation is opposite that of the anilox roll 12.

The intermediate transfer roll 14 may have a soft surface. For example, the surface may include rubber, or elastomer such as EPDM. The intermediate transfer roll 14 may be a rotatable drum, or other member suitable for defining an ink transfer nip with an anilox roll 12 and a hard form roll such as form roll 16. The soft intermediate transfer roll 14 may define a second ink transfer nip 22 with the hard form roll 16. The intermediate transfer roll 14 may transfer ink from the anilox roll 12 to the hard form roll 16 in a uniform layer.

In an embodiment, the intermediate transfer roll 14 may be configured to be urgable against the anilox roll 12 at the transfer nip for increasing a pressure applied to ink at the nip for squeezing the ink to spread and smooth the ink for metering the ink onto the intermediate transfer member in a uniform layer. In an embodiment, the intermediate transfer roll or member 14 may be urgable against the form roll or member 16 at the second ink transfer nip for increasing a pressure applied to ink at the nip for squeezing the ink to spread and smooth the ink for metering a uniform layer of ink onto the hard surface of the form roll 16. In an embodiment, the intermediate transfer roll 14 may be configured to oscillate slowly back and forth in a direction perpendicular to the high speed rotation the anilox roll or member 12 and the form roll or member 16.

In an embodiment, a transfer member such as the intermediate transfer roll 14 may be rotatable and set to rotate at a velocity V1 set directly, for example, by a servo motor or set indirectly through friction with the anilox roller 12. A form member such as form roll 16 may be rotatable and set to rotate at a velocity V2 set, for example, by an independent servo motor. In an embodiment, V2 may equal V1. Alternatively, V1 may differ from V2 slightly causing a small amount of controlled slippage. One or both of V1 and V2 may be adjusted to enhance uniformity of the ink layer transferred onto the hard form roll 16 from the soft intermediate transfer roll 14 at the second transfer nip 22. A diameter of the form roll 16 may be greater than or less than a diameter of the soft intermediate transfer roll 14.

As shown in FIG. 1, the form roll 16 may define a third ink transfer nip 24 with an imaging member 18, and in particular, with a conformable, reimageable surface layer 26 of the imaging member 18. The imaging member 18 may be a roll as shown in FIG. 1, and the reimageable surface layer 26 may form an outer layer of the imaging member 18. Alternatively, the member may include a plate wrapped around a cylinder or a belt. The reimageable surface layer 26 is soft, conformable, and reimageable. For example, the surface layer 26 may include a silicone. An imaging member 18 may carry a surface layer 26 comprising, for example, a silicone imaging blanket. The surface layer 26 of the imaging member 18 may be wear resistant and flexible. The digital imaging member 18 may be a roll configured to rotate in a direction that opposes a direction of rotation of the form roll 16. At the third transfer nip 24, ink may be metered from the hard form roll 16 to the digital imaging member 18 in a uniform layer.

As the hard form roll 16 contacts the reimageable surface layer 26 at the third transfer nip 24 to squeeze ink therebetween and transfer the ink onto the soft surface layer 26 of the imaging member 18, some ink may be left behind on the hard form roll 16. Further, as the hard form roll 16 contacts the digital imaging member 18 at the third ink transfer nip to squeeze ink therebetween, dampening fluid deposited on the reimageable surface layer 26 prior to ink transfer may migrate from the digital imaging member 18 to the hard form roll 16. Accordingly, the dampening fluid may be mixed with leftover ink on a surface of the form roll 16 that after ink transfer to the digital imaging member 18 at the third transfer nip.

As shown in FIG. 1, a chamber blade system 28 may be positioned substantially below the inking apparatus. The chamber blade system 28 may include a chamber blade 30, an anilox doctor blade 32, and a form member doctor blade 34. The chamber blade system 28 may be an ink housing 36 including a bottom portion 38. The ink housing is configured to contain ink within a cavity of the ink housing. As shown in FIG. 1, the bottom portion 38, anilox doctor blade 32, and chamber blade 30 may together define an exemplary cavity. The bottom portion 38 of the chamber blade system 28 of FIG. 1 may angled downward, as shown, from a position adjacent to the form roll 16 at a first end 40 of the bottom portion 38, to a position adjacent to the anilox roll 12 at a second end 42. The upper portion of the cavity may correspond to a removed ink reservoir, and the bottom portion of the cavity may correspond to an ink sump for supplying ink to the anilox roll 12.

The chamber blade 30 may be configured to contact a surface of the form roll 16. The chamber blade 30 may include a flexible hydrophilic material if water based dampening solution is used, and thus, the hydrophilic chamber blade 30 may wick away water-based dampening fluid 52 from the surface of the form roll 16. Alternatively if other dampening fluid chemistries are used, the chamber blade may be made of other materials (e.g., fluorocarbon, viton, TEFLON) designed to efficiently wick away the type of dampening fluid used.

Because the form roll 16 has a hard surface, the form roll doctor blade 34 may be configured to contact a surface of the form roll 16 for removing leftover ink from a surface of the form roll 16. The form roll doctor blade 34 may include a metal material, or other material suitable for removing ink from the hard surface of the form roll 16. The form roll doctor blade 34 may be fixed to the bottom portion 38 via a blade holder 44 there between configured to attach the form roll doctor blade to the bottom portion while allowing very high viscosity ink flow from the upper portion of the cavity at the first end 40 to the bottom portion of the cavity at the second end 42. The form roll doctor blade 34 may remove residual ink from the form roll that did not transfer to the imaging member 18. The removed ink 54 removed by the doctor blade 34 may be received by the upper portion of the cavity corresponding to the removed ink reservoir. This ink may flow to the bottom portion of the cavity corresponding to the ink sump for mixing with supply ink 56. The supply ink 56 may contain the recycled removed ink 54, and may be heated and supplied to the anilox roll 12.

The inventors found that providing a controlled heater near the back of the anilox doctor blade 32 may dramatically improve ink flow of high viscosity inks in the vicinity of the doctoring blade. FIG. 1 shows a heater 46 as a heat element provided separate from the anilox member 12 and adjacent the anilox doctor blade 32 and the ink at the bottom portion of the cavity. While the anilox member 12 may be heated, the heater 46 is an independent heat element spatially separate from the anilox member and not a part of the anilox member. Further, while heat from the heater 46 may radiate to the anilox member surface, it is understood that the heater 46 is designed to heat ink that will be metered onto the anilox member surface.

The heater 46 may be a heat strip configured to heat the ink near the anilox doctor blade 32 and reduce the viscosity of the ink to increase ink flow where the anilox roll doctor blade meters the ink onto the anilox member 12. While not being limited to a particular theory, the heater 46 may be a heat element (e.g., strip, coil, ribbon) of conductive wire (e.g., nichrome, nichrome embedded in ceramic) placed adjacent the intersection of the anilox doctor blade 32 and the bottom portion.

Still referring to FIG. 1, the heater 46 is depicted as a heat strip within the cavity of the ink housing 36 at the backside of the anilox doctor blade and on the bottom portion. In an example, the heat strip is part of or coupled to a clamp 50 or other blade holder securing the anilox doctor blade to the bottom portion. In another example, the heater may be clamped to the front side of the anilox doctor blade opposite the cavity. In yet another example, the heater 46 may be coupled to or at least partly embedded in the bottom portion 28 at the second end near the anilox doctor blade. The heater may be at least partially submerged in the ink stored in the ink housing. In this example, the heater 46 is intentionally designed to heat (e.g., upon converting energy of the electric current flowing there through) the ink in the cavity at the second end 42 adjacent the anilox doctor blade, and may be positioned to maximize the heating of the ink. In the examples the heater 46 may heat ink from about 40 degrees C. having a very high viscosity above a million cps to about 60 degrees C. having a lowered viscosity of about 100,000-1,000,000 cps.

Figure 3:
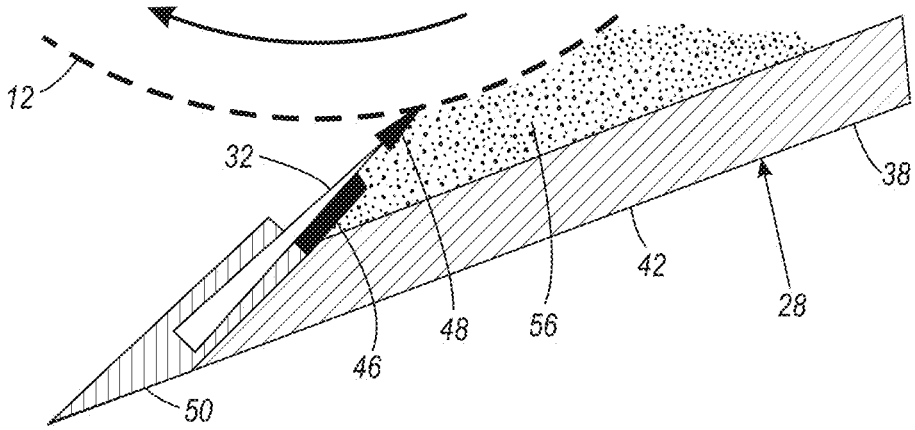
FIG. 3 is an enlarged partial view of a variable lithographic inking apparatus in accordance with examples of the embodiments.

The anilox doctor blade 32 may include a ceramic tip coating 48 (e.g., RMB Durablade™ product available through TKM United States Inc.). FIG. 3 depicts an enlarged partial view of an anilox doctor blade 32, bottom portion 38 and anilox roll 12. In the example of FIG. 3, the anilox doctor blade 32 is attached to the bottom portion by a clamp 50, which also includes the heater 46 adjacent the anilox doctor blade. The ceramic coating 48 at the anilox doctor blade tip allows the blade to survive much longer when used with higher viscosity inks and harsher hard pigments such as a white ink with titanium dioxide. The ceramic coated tip also allows a small amount of controlled ink flow through that can wet the lands thereby reducing the hydrodynamic back pressures and friction when trying to force the ink into the anilox cells. While not being limited to a particular theory, ceramic coated blades of higher stiffness and thickness (e.g., 10-12 mils) may be preferred for these inks. Further, an anilox doctor blade angle in the range of 25-30 degrees may be ideal for metering the very high viscosity inks onto the anilox roll 12.

As the anilox roll 12 rotates through the ink sump as shown in FIG. 1, the anilox doctor blade 32 contacts the ART engraved patterned surface of the anilox member 12 to meter and level heated lowered viscosity ink in the cells of the anilox member. The anilox doctor blade 32, chamber blade system bottom portion 38, and hydrophilic chamber blade system 28 together contain the ink of the removed ink reservoir and/or the ink sump. The chamber blade system 28 may span both the anilox roll 12 and the form roll 16, an arrangement that may reduce an overall size of the inking system, and thus, reduce costs.

Figure 4:
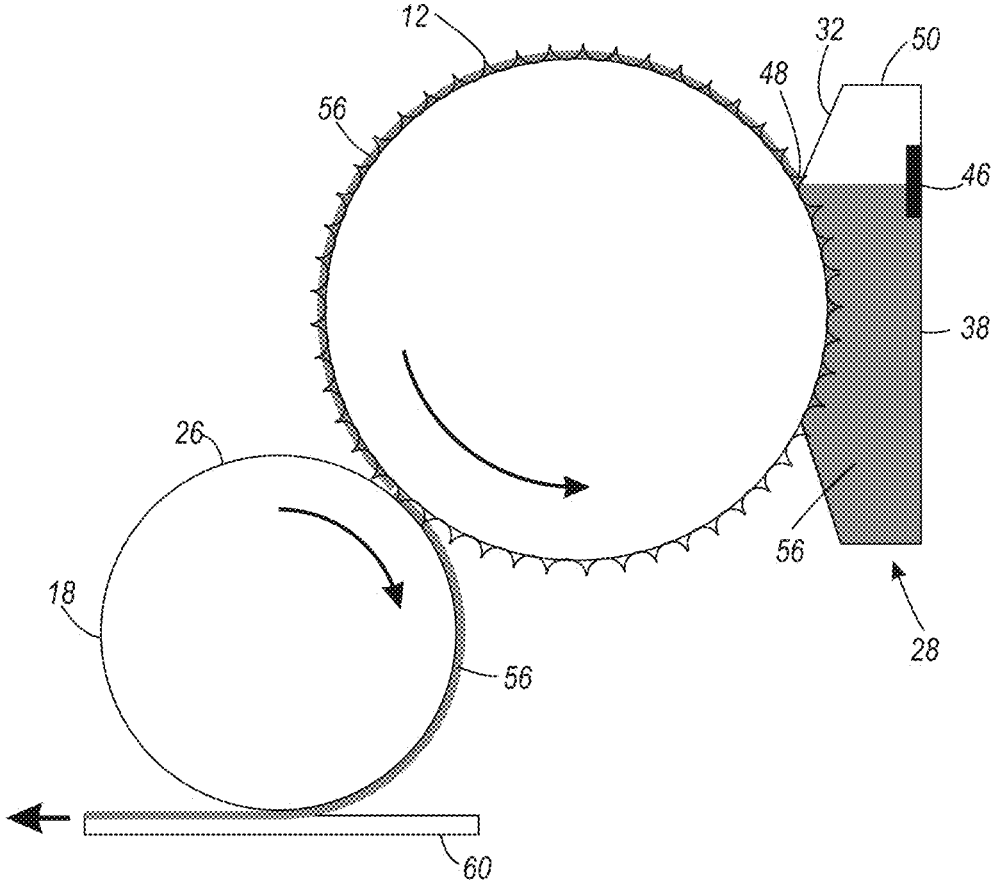
FIG. 4 is a side view of a variable lithographic inking system in accordance with another example of the embodiments.

FIG. 4 depicts an exemplary inking apparatus 58 having the anilox roll 12 configured to transfer the very high viscosity ink directly to the imaging member 18. In FIG. 4, a chamber blade system 28 may be positioned substantially aside the anilox roll 12. The chamber blade system 28 may include a chamber blade 30, an anilox doctor blade 32, and a bottom portion 38 that define an ink sump for storing very high viscosity ink.

In the example depicted in FIG. 4, the heater 46 is attached to the bottom portion 46 near the clamp 50 and anilox doctor blade 32 to heat the ink near the anilox doctor blade tip that is shown in contact with the anilox roll 12. While not being limited to a particular theory, the heater 46 is preferably positioned near the portion of ink adjacent the anilox doctor blade tip to intentionally heat the ink, and lower the viscosity of the ink where it is metered into the ART patterned cells of the rotating anilox roll 12 by the anilox doctor blade. The rotating anilox roll 12 may transfer the ink directly to the imaging member 18 for printing on the print media 60.

Figure 5:
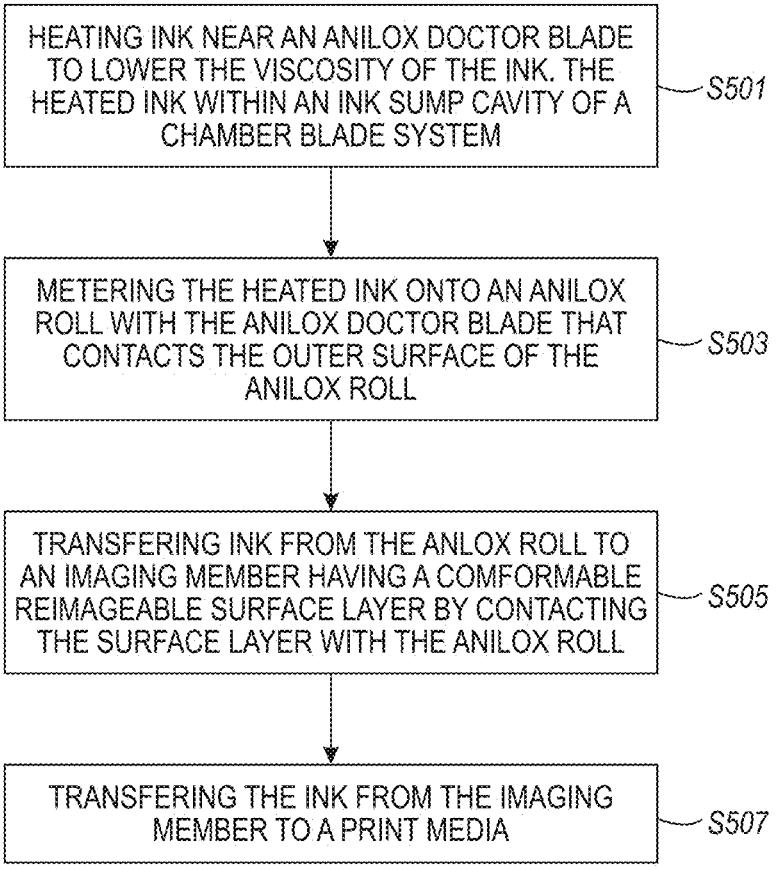
FIG. 5 shows a variable lithographic inking metering process in accordance with an exemplary embodiment.

FIG. 5 shows methods for variable lithographic keyless inking metering in accordance with an embodiment. Specifically, methods for metering may include heating ink near an anilox doctor blade to lower the viscosity of the ink, with the heated ink within an ink sump cavity of a chamber blade system, at Step S501. The ink may be a very high viscosity ink heated by a heat strip to lower the viscosity of the very high viscosity ink, for example having a viscosity above a million cps at an ink temperature less than about 40 degrees C. to about 100,000-1,000,000 cps at an ink temperature of at least about 60 degrees C.

At Step S503, the anilox doctor blade contacts the outer surface of the anilox roll and meters the heated ink onto the anilox roll. In the examples, the anilox doctor blade contacts patterned (e.g., ART engraved) surface of the anilox member to meter and level heated lowered viscosity ink in the cells of the anilox member as the anilox roll rotates through the ink sump and lowered viscosity ink adjacent the anilox doctor blade.

Methods for metering may include transferring ink from the anilox member such as a roll to an imaging member, which may have a conformable reimageable surface layer by contacting the surface layer with the anilox roll, at Step S505. The anilox roll and the imaging member may define an ink transfer nip. A pressure may be applied to ink and the imaging member at the nip for achieving transfer of a uniform layer of the ink onto the conformable surface of the imaging member. Methods may also include transferring ink from the imaging member to print media, such as paper, at Step S507 as readily understood by a skilled artisan.

Figure 6:
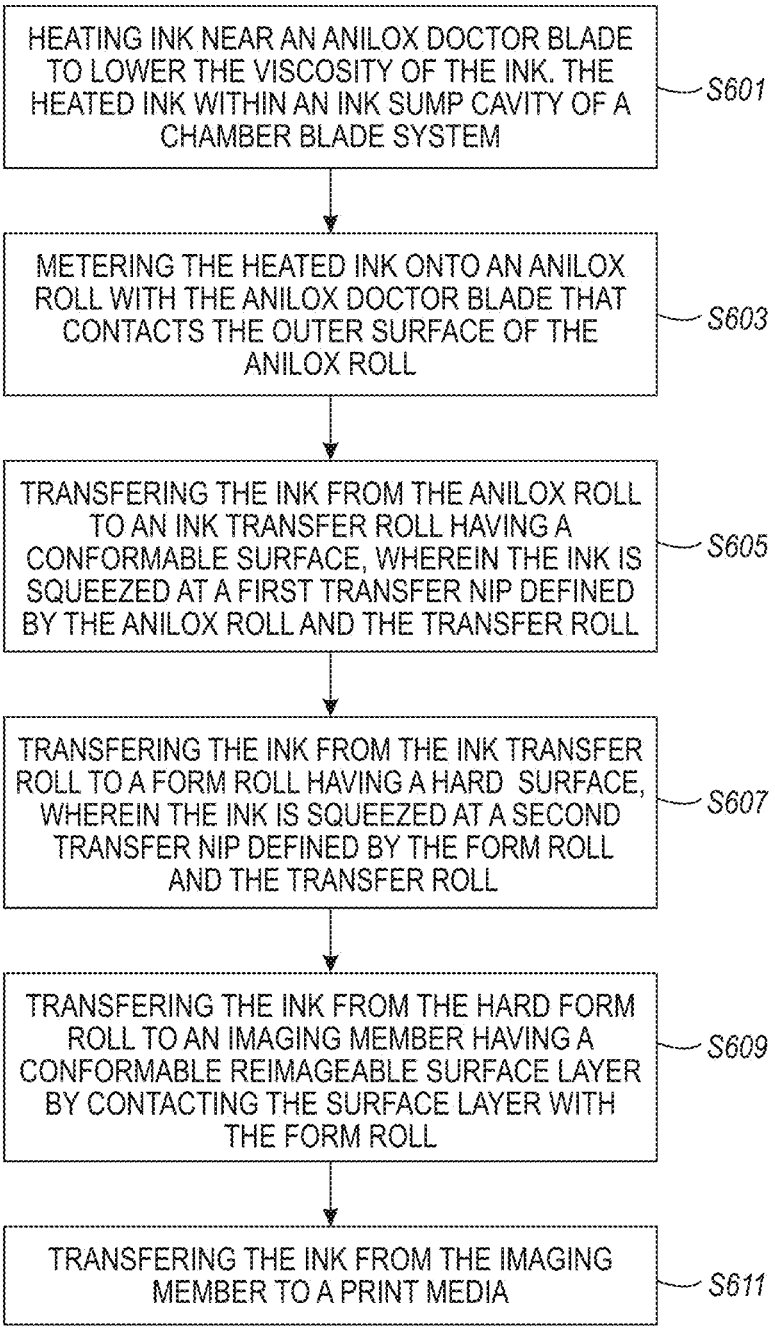
FIG. 6 shows a variable lithographic inking metering process in accordance with an exemplary embodiment.

FIG. 6 shows methods for variable lithographic keyless inking metering, including heating, metering, and transfer methods in accordance with an example. Specifically, methods may include heating ink near an anilox doctor blade to lower the viscosity of the ink, with the heated ink within an ink sump cavity of a chamber blade system, at Step S601. The ink may be a very high viscosity ink heated by a heat strip to lower the viscosity of the very high viscosity ink, for example having a viscosity above a million cps at an ink temperature less than about 40 degrees C. to about 100,000-1,000,000 cps at an ink temperature of at least about 60 degrees C.

At Step S603, the anilox doctor blade contacts the outer surface of the anilox roll and meters the heated ink onto the anilox roll. In the examples, the anilox doctor blade contacts the patterned (e.g., ART engraved) surface of the anilox member to meter and level heated lowered viscosity ink in the cells of the anilox member as the anilox roll rotates through the ink sump and lowered viscosity ink adjacent the anilox doctor blade.

Methods for metering may include transferring ink from the anilox member to an ink transfer roll having a conformable surface at Step S605. The anilox member and the transfer roll may define a first ink transfer nip at which ink may be squeezed and spread during metering of the ink from the anilox member to the ink transfer roll.

At Step S607, the ink metered in a uniform layer onto a surface of the ink transfer roll may be transferred from the transfer roll to a form roll. The form roll may have a hard surface, and may include, for example, metal. The ink may be squeezed at a second transfer nip defined by the conformable transfer roll and the hard form roll to meter a uniform layer of ink onto the form roll.

At Step S609, the ink may be transferred from the hard form roll to an imaging member such as a digital imaging plate or roll. The hard transfer roll and the imaging roll may define a third ink transfer nip. The imaging member includes a soft, conformable reimageable surface layer onto which the ink is transferred from the form roll. For example, the surface layer of the imaging member may include silicone or a fluorosilicone. Methods may also include transferring ink from the imaging member to print media, such as paper, at Step S611 as readily understood by a skilled artisan.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A variable lithographic inking method, comprising:

directly heating high rheology ink within an ink housing of a chamber blade system near an anilox doctor blade attached to the ink housing with a heater spatially separate from an anilox member, the high rheology ink having a first viscosity of at least 100,000 cPs at a first temperature of at least 60° C. and a second viscosity higher than the first viscosity at a second temperature lower than the first temperature, the ink housing having a first end distal the anilox doctor blade and a second end adjacent the anilox doctor blade, the heater configured to heat the high rheology ink at an intersection of the anilox member and the anilox doctor blade to a temperature greater than the second temperature of the high rheology ink at the first end of the ink housing and to reduce the viscosity of the high rheology ink near the intersection and increase ink flow, the heating lowering the viscosity of the heated high rheology ink near the anilox doctor blade at the second end of the ink housing relative to the high rheology ink at the first end of the ink housing;

metering the heated high rheology ink from the ink housing onto the anilox roll with the anilox doctor blade that contacts the outer surface of the anilox roll; and transferring the metered high rheology ink from the anilox roll to an imaging member having a conformable reimageable surface layer for variable data lithographic printing.

2. The method of claim 1, the transferring the metered high rheology ink from the anilox roll to the imaging member further comprising:

transferring the high rheology ink from the anilox roll to an ink transfer roll having a conformable surface, wherein the high rheology ink is squeezed at a first transfer nip defined by the anilox roll and the transfer roll;

transferring the high rheology ink from the ink transfer roll to a form roll having a hard surface, wherein the high rheology ink is squeezed at a second transfer nip defined by the form roll and the transfer roll;

transferring the high rheology ink from the hard form roll to the imaging member at a third transfer nip defined by the form roll and the surface layer of the imaging member;

removing the high rheology ink from the form member that remains on the form member after the third transfer nip via a form member doctor blade attached to the ink housing and in contact with the form member; and removing dampening fluid from the form member that remains on the form member after the third transfer nip and before the form member doctor blade via a chamber blade attached to the ink housing and in contact with the form member between the third transfer nip and the form member doctor blade.

3. The method of claim 1, the heating further comprising heating the high rheology ink to at least 60 degrees C. and reducing the viscosity of the high rheology ink from over one million cPs to 100,000-1,000,000 cPs.

4. The method of claim 1, the metering further comprising metering the heated high rheology ink from the ink housing onto the anilox roll having a reverse art technology pattern with a metered volume of 2-3 BCM and a line screen of at least 800 LPI.

5. The method of claim 1, the heating further comprising heating the high rheology ink with a heated blade clamp holding the anilox doctor blade against the anilox member, the heated blade clamp including the heater.

6. The method of claim 1, further comprising reducing hydrodynamic back pressures and friction between the anilox doctor blade and the anilox member when trying to meter the high rheology ink into cells of the anilox member with a ceramic tip coating of the anilox doctor blade configured to allow controlled ink flow through the ceramic coating to wet lands of the anilox member.

* * * * *